US009091957B1

(12) United States Patent
Matsuo et al.

(10) Patent No.: US 9,091,957 B1
(45) Date of Patent: Jul. 28, 2015

(54) OPTICAL WRITER AND IMAGE FORMING APPARATUS

(71) Applicant: Konica Minolta, Inc., Tokyo (JP)

(72) Inventors: Takahiro Matsuo, Aichi (JP); Yasushi Nagasaka, Aichi (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/614,221

(22) Filed: Feb. 4, 2015

(30) Foreign Application Priority Data

Feb. 17, 2014 (JP) ..... 2014-027281

(51) Int. Cl.
*B41J 2/385* (2006.01)
*G03G 15/043* (2006.01)

(52) U.S. Cl.
CPC ..... *G03G 15/043* (2013.01)

(58) Field of Classification Search
USPC ..... 347/118, 130, 138, 238, 241, 242, 256, 347/257
See application file for complete search history.

(56) References Cited

U.S. PATENT DOCUMENTS

| | | | | |
|---|---|---|---|---|
| 4,821,051 | A * | 4/1989 | Hediger | 347/130 |
| 5,612,767 | A * | 3/1997 | Iwama | 347/242 |
| 6,995,782 | B2 * | 2/2006 | Oda et al. | 347/138 |
| 7,505,059 | B2 * | 3/2009 | Inoue et al. | 347/238 |

FOREIGN PATENT DOCUMENTS

| | | |
|---|---|---|
| JP | 63-091602 | 4/1988 |

* cited by examiner

*Primary Examiner* — Kristal Feggins
(74) *Attorney, Agent, or Firm* — Squire Patton Boggs (US) LLP

(57) ABSTRACT

Disclosed is an optical writer including a light source substrate including a base and a plurality of light sources disposed on the base, a rod lens array comprising a plurality of rod lenses having an optical axis, the rod lens array having a higher linear expansion coefficient than a linear expansion coefficient of the base of the light source substrate and the rod lens array being configured to condense light from the light sources onto an image retainer, a holder supporting the light source substrate and the rod lens array and restraining plates bonded to respective elongated faces of the rod lens array with thin adhesive layers, the elongated faces being parallel to the optical axis of the rod lenses, wherein the restraining plates and the holder each have a lower linear expansion coefficient than the linear expansion coefficient of the rod lens array.

11 Claims, 6 Drawing Sheets

OPTICAL WRITER AND IMAGE FORMING APPARATUS

BACKGROUND OF THE INVENTION

1. Field of the Invention

The present invention relates to an optical writer and an image forming apparatus including the optical writer.

2. Description of Related Art

Traditional optical writers include gradient-index rod lens arrays (Selfoc (registered trademark) lens arrays; SLAs (registered trademark)) functioning as optical devices. The SLAs each include multiple rod lenses. An error in the fabrication or a warp and/or distortion of the SLA due to the mounting of the rod lens array causes a variation in the distances in the optical axis direction between the individual rod lenses and their corresponding luminous points. The SLA thus has an error in the performance of image formation on the image plane, leading to inferior image quality.

In order to solve the above problem, an example improved SLA includes a convergent rod lens array including rod lenses having end faces aligned in the same plane, a restraining plate disposed on at least one side face of the convergent rod lens array, and an adhesive filled between the convergent rod lens array and the restraining plate (for example, refer to JP S63-91602).

In recent years, optical writers have been developed that include organic light-emitting diodes (OLEDs) in the form of light sources of SLAs. In a general LED print head (LPH) including light emitting diodes (LEDs), multiple light source blocks are connected to define a linear luminous unit. This configuration causes uneven illumination due to an irregular arrangement of the luminous points of the light source blocks and/or a misalignment of the light source blocks. In contrast, the OLEDs are integrated into a single light source. This configuration can avoid the uneven illumination, which is the most serious problem in LPHs.

Unfortunately, a substrate of the OLED light source is subjected to high temperature during the fabrication. The base of the substrate thus should be composed of glass having a particularly low linear expansion coefficient. In other words, the OLED light source has the substrate having a significantly low linear expansion coefficient that differs from that of the SLA. In addition, the substrate of the OLED light source and the SLA each have an elongated shape. Thus, especially problematic is the difference in the thermal expansion between the substrate and the SLA in the longitudinal direction in response to a variation in environmental temperature. FIG. 11 illustrates the difference in the thermal expansion between a light source substrate 1 and an SLA 2. In FIG. 11, the length of arrows D1 indicates the thermal expansion of the light source substrate 1, and the length of arrows D2 indicates the thermal expansion of the SLA 2. A difference in the thermal expansion between the light source substrate 1 and the SLA 2 causes displacement of the rod lenses in the SLA 2 relative to luminous points on the light source substrate 1, leading to inferior image quality.

In addition to the difference in the linear expansion coefficient between the light source substrate 1 and the SLA 2, the difference in the linear expansion coefficient between the SLA 2 and a holder retaining the SLA 2 also leads to displacement of the rod lenses relative to the luminous points.

In general, the light source substrate 1 is bonded to the holder in planes substantially perpendicular to the optical axis of the rod lenses. This configuration can achieve high accuracy of the bearing surface of the holder. The light source substrate 1 thus can be bonded onto the holder via thin layers.

In contrast, with reference to FIG. 12, the SLA 2 is bonded to opposite inner faces of a square-tube holder 3, which are substantially parallel to the optical axis. Unfortunately, the holder 3 is fabricated through molding and thus has draft angles on the inner faces. The SLA 2 bonded onto such a holder 3 via thin layers causes inclination and/or distortion of the rod lenses, leading to inferior optical performance. The SLA 2 is thus bonded to the holder 3 with an adhesive E1 having a sufficient thickness.

Since the light source substrate 1 adheres to the holder 3 via thin low-stiffness adhesive layers, the longitudinal centers of the light source substrate 1 and the holder 3 are not readily displaced relative to each other in response to a variation in environmental temperature. In contrast, the SLA 2 adhering to the holder 3 via thick low-stiffness adhesive layers can be anchored to the holder 3 at irregular positions because of the uneven application of the adhesive E1 or the build-up of stress by the curing of the adhesive E1. The longitudinal centers of the SLA 2 and the holder 3 thus can be displaced relative to each other because of the difference in the linear expansion coefficient (refer to an arrow D3 in FIG. 12).

As disclosed in JP S63-91602, the restraining plate is bonded to the SLA to prevent a warp and distortion of the SLA in the optical axis direction. JP S63-91602, however, does not mention the linear expansion coefficient of the restraining plate. In other words, the restraining plate cannot compensate for the difference in the linear expansion coefficient between the SLA and the holder, and thus cannot prevent the displacement of the SLA relative to the holder due to the difference in the linear expansion coefficient. Furthermore, JP S63-91602 discloses no technique to dispose the restraining plate uniformly onto the SLA. In other words, an adhesive E2 between the SLA 2 and a restraining plate 4 inevitably has an uneven thickness, as illustrated in FIG. 13. The restraining plate 4 is thus partially peeled from the SLA 2 in response to local shearing stress caused by a variation in environmental temperature, in particular, at a portion including the adhesive E2 thinner than those in the other portions. This phenomenon leads to a warp and/or distortion of the SLA 2.

SUMMARY OF THE INVENTION

An object of the invention, which has been accomplished to solve the above problems, is to provide an optical writer including rod lenses that are not readily displaced relative to luminous points in response to a variation in environmental temperature and restraining plates bonded to the rod lens array without a warp and distortion of the rod lens array, and to provide an image forming apparatus including the optical writer.

In order to realize at least one of the above problems, an optical writer reflecting one aspect of the invention includes a light source substrate including a base and a plurality of light sources disposed on the base, a rod lens array comprising a plurality of rod lenses having an optical axis, the rod lens array having a higher linear expansion coefficient than a linear expansion coefficient of the base of the light source substrate and the rod lens array being configured to condense light from the light sources onto an image retainer, a holder supporting the light source substrate and the rod lens array, and restraining plates bonded to respective elongated faces of the rod lens array with thin adhesive layers, the elongated faces being parallel to the optical axis of the rod lenses, and the light source substrate is bonded directly or via an intermediate member to the holder with a thin adhesive layer, the rod lens array is bonded via the restraining plates to the holder with adhesive layers which are thicker than the thin adhesive layer, the restraining plates each have a shorter length in a direction perpendicular to the elongated faces of the rod lens array than a length of the restraining plate in a direction of the optical axis, and the restraining plates and the holder each have a lower linear expansion coefficient than the linear expansion coefficient of the rod lens array.

Preferably, the length of each of the restraining plates in the direction perpendicular to the elongated faces of the rod lens array is invariable along the optical axis.

Preferably, the restraining plates each comprise a plurality of recesses on a face adhering to the rod lens array, the recesses being disposed along the optical axis in a longitudinal direction of the restraining plate.

Preferably, the recesses are formed through machining.

Preferably, the recesses are disposed at regular intervals in the longitudinal direction.

Preferably, the rod lens array and the restraining plates adhering to the rod lens array define a rod lens array unit, and a difference between an overall linear expansion coefficient of the rod lens array unit and the linear expansion coefficient of the holder is smaller than a difference between the linear expansion coefficient of the base of the light source substrate and the linear expansion coefficient of the holder.

Preferably, the restraining plates are each composed of a sheet metal, and a difference between the linear expansion coefficient of the restraining plates and the linear expansion coefficient of the holder is smaller than the difference between the linear expansion coefficient of the base of the light source substrate and the linear expansion coefficient of the holder.

Preferably, the restraining plates are longer than the rod lens array in the direction of the optical axis.

Preferably, the restraining plates are symmetric about a plane extending through the center of the rod lens array in the direction of the optical axis, the plane being perpendicular to the optical axis.

Preferably, the restraining plates are symmetric about a plane extending through the center of the rod lens array in the direction perpendicular to the elongated faces of the rod lens array, the plane being parallel to the elongated faces of the rod lens array.

Further, an image forming apparatus reflecting one aspect of the present invention includes an image retainer, a charger to charge the image retainer, the optical writer according to claim 1, the optical writer being configured to form an electrostatic latent image on the image retainer charged by the charger through irradiation of the image retainer with light, a developer to convert the electrostatic latent image into a visible developer image through supply of a developing agent to the irradiated imager retainer, a transferrer to transfer the developer image to a sheet, and a fixer to fix the developer image transferred by the transferrer onto the sheet.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Preferred embodiments of the invention will now be described with reference to the accompanying drawings.

Figure 1:
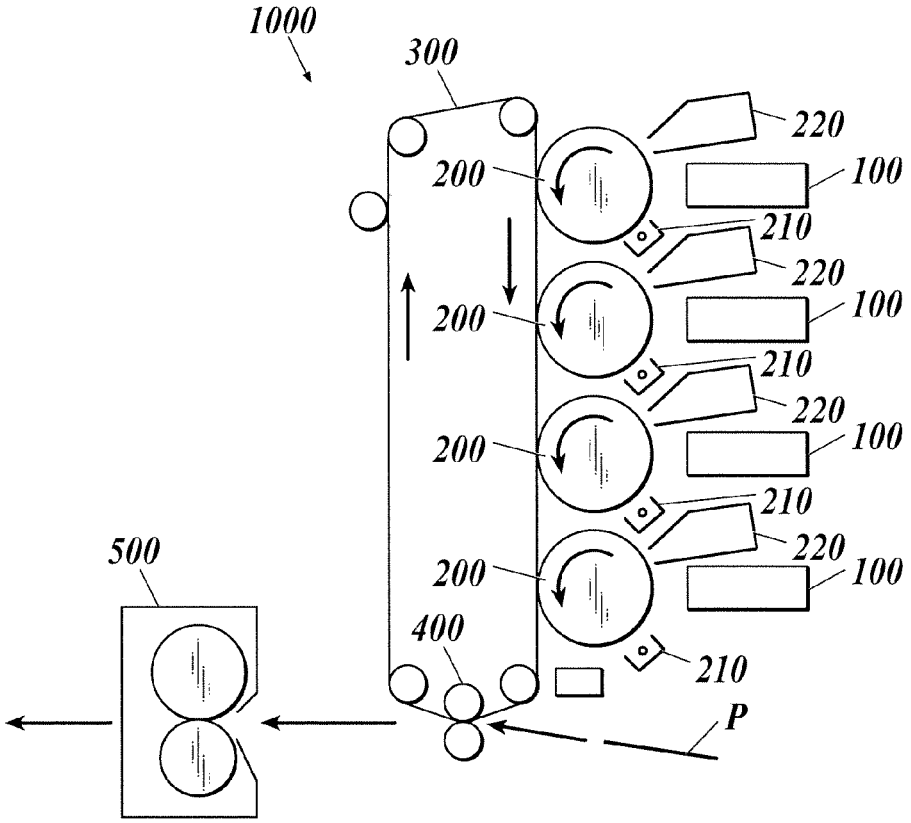
FIG. 1 is a schematic diagram illustrating an image forming apparatus according to an embodiment.

An image forming apparatus 1000 according to an embodiment functions as, for example, a printer or a digital copier. With reference to FIG. 1, the image forming apparatus 1000 includes optical print heads (optical writers) 100 of the respective colors of cyan, magenta, yellow, and black; image retainers 200, such as photoreceptor drums, corresponding to the respective optical print heads 100; chargers 210 to charge the respective image retainers 200; developers 220 to convert electrostatic latent images into visible developer images formed with a developing agent, through the supply of the developing agent to the respective illuminated image retainers 200; an intermediate transferring belt 300; a transferring roller (transferrer) 400 to transfer the developer images to a sheet P; and a fixer 500 to fix the developer images transferred by the transferring roller 400 onto the sheet P.

The image forming apparatus 1000 forms electrostatic latent images on the image retainers 200 with light emitted from the respective optical print heads 100. The image forming apparatus 1000 then supplies the developing agent to the image retainers 200 retaining the electrostatic latent images to convert the electrostatic latent images into visible developer images, and transfers the developer images to the intermediate transferring belt 300. The image forming apparatus 1000 then transfers the developer images retained on the intermediate transferring belt 300 to the sheet P through the press with the transferring rollers 400. The image forming apparatus 1000 then heats and pressurizes the sheet P with the fixer 500 to fix the developer images onto the sheet P. The image forming apparatus 1000 then discharges the sheet P with discharging rollers (not shown) to a tray (not shown). This process completes the image formation.

Figure 2:
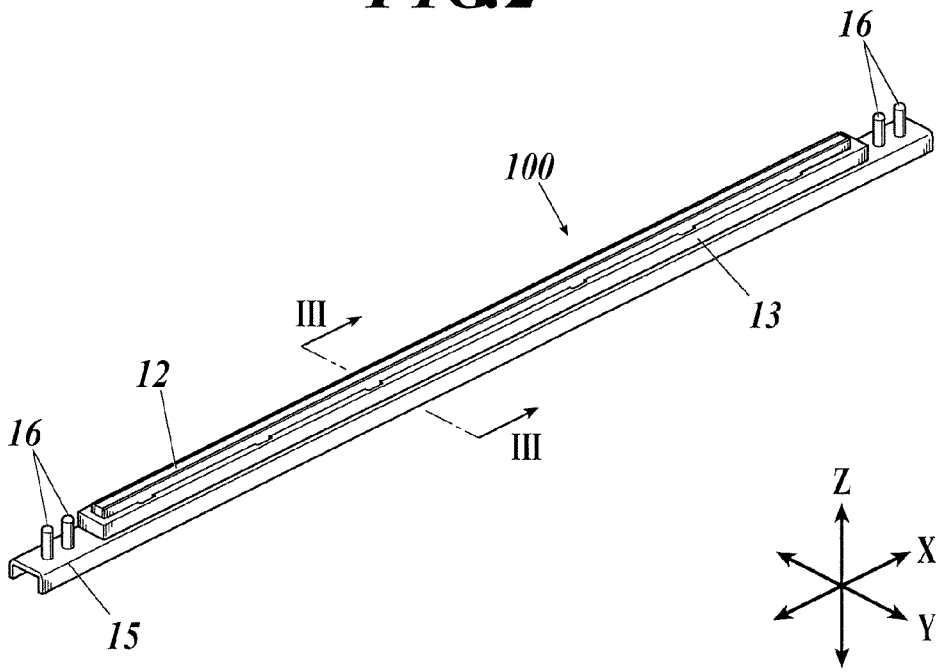
FIG. 2 is a perspective view of the entire configuration of an optical print head according to the embodiment.
Figure 3:
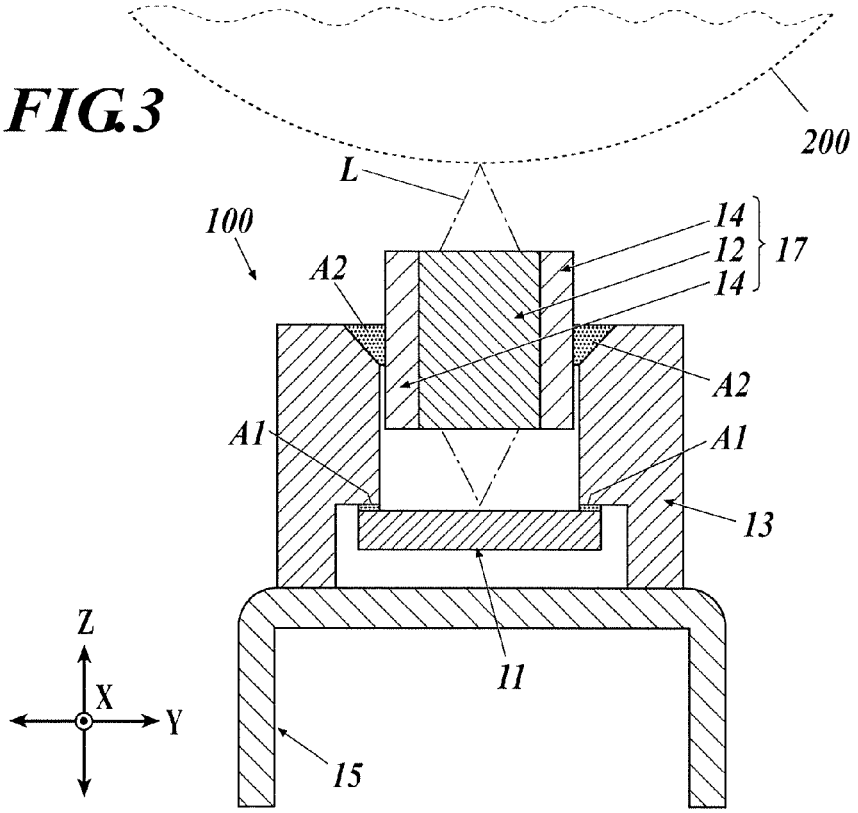
FIG. 3 is an example cross-sectional view of the optical print head illustrated in FIG. 2 along a line III-III.

With reference to FIGS. 1 to 3, the optical print heads 100 emit light L to the image retainers 200 charged by the respective chargers 210 to form electrostatic latent images on the image retainers 200. The optical print heads 100 each include a light source substrate 11 including multiple luminous elements (light sources) 112 (refer to FIG. 5) to emit light L, a gradient-index rod lens array 12 (hereinafter referred to as "SLA 12") to condense the light L from the luminous elements 112 of the light source substrate 11 onto the image retainer 200, restraining plates 14 bonded to the SLA 12 to prevent a warp and distortion of the SLA 12 in the optical axis direction, and a holder 13 supporting these components.

Figure 4A:
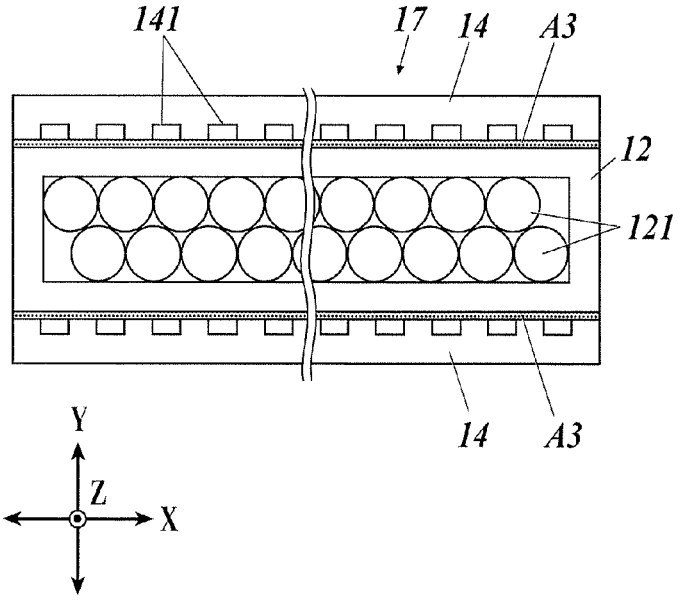
FIG. 4A is a schematic plan view of a rod lens array provided with restraining plates.
Figure 4B:
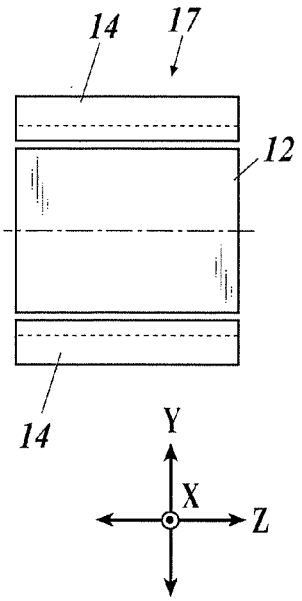
FIG. 4B is a schematic side view of a rod lens array provided with restraining plates.

In the following description, the longitudinal direction of the SLA 12 illustrated in FIGS. 2 to 4 is defined as "X direction," the shorter direction as "Y direction," and the direction perpendicular to both the X and Y directions as "Z direction." The protruding direction of alignment pins 16 (refer to FIG. 2) in the optical print head 100 illustrated in FIGS. 2 to 4 is defined as "upward direction," and the opposite direction as "downward direction." According to the embodiment, the light L is emitted from the light source substrate 11 of the optical print head 100 upward in the Z direction. In other words, the Z direction is aligned with the direction of the optical axis of the light L.

It is noted that the illustration of the components, other than the SLA 12 and the restraining plates 14, is omitted in FIG. 4.

Figure 5:
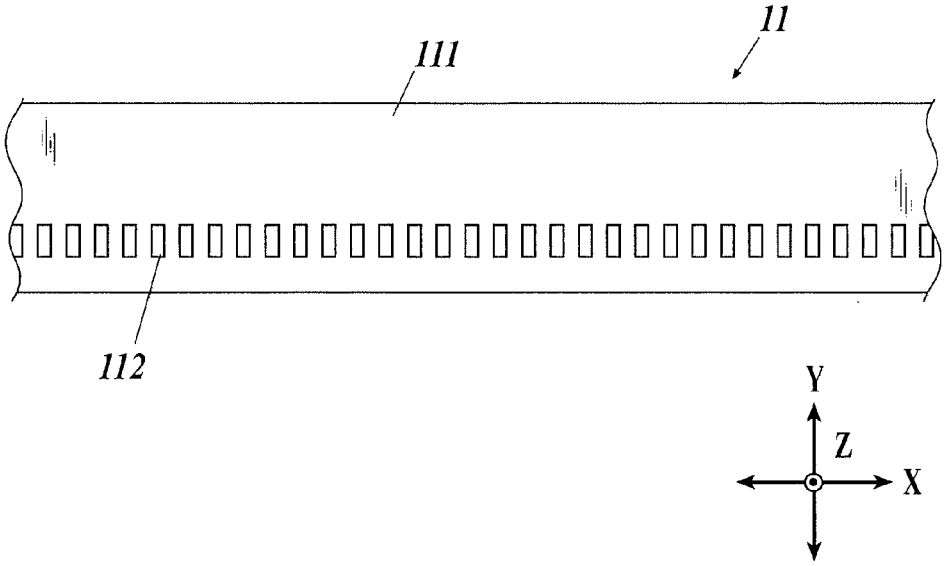
FIG. 5 is a schematic plan view of a light source substrate.

With reference to FIG. 5, the light source substrate 11 includes a substantially rectangular base 111 and multiple luminous elements 112 aligned in a substantially straight line on the base 111. Alternatively, the luminous elements 112 may be aligned in multiple (e.g., three) substantially straight lines arranged in the shorter direction (Y direction). The luminous elements 112 in such multiple lines are arranged in a zigzag manner. In specific, the positions of the luminous elements 112 in one line are slightly shifted in the longitudinal direction (X direction) from those in another line, such that they do not overlap with each other in the Y direction on the light source substrate 11. According to the embodiment, the luminous elements 112 include OLEDs, and the base 111 of the light source substrate 11 is composed of glass (e.g., alkali-free glass) having a low linear expansion coefficient.

The light source substrate 11 is bonded with thin adhesive layers A1 to the holder 13 in planes (XY planes) substantially perpendicular to the optical axis direction (Z direction) of rod lenses 121 in the SLA 12. The adhesive layers A1 are composed of a uv curable adhesive, for example.

The SLA 12 is disposed between the light source substrate 11 and the image retainer 200. The SLA 12 includes multiple rod lenses 121, which are aligned in substantially parallel to the line(s) of the luminous elements 112 on the light source substrate 11. The rod lenses 121 each have a refractive index gradually increasing from the central axis (i.e., optical axis) to the periphery. The light beams from the luminous elements 112 of the light source substrate 11 pass through the rod lenses 121 in the SLA 12 and form minute spots on the surface of the image retainer 200. The SLA 12 is composed of, for example, a fiber reinforced plastic (FRP), and has a higher linear expansion coefficient than that of the base 111 of the light source substrate 11.

The SLA 12 is bonded to the holder 13 via the restraining plates 14 with relatively thick adhesive layers A2 each having a sufficient thickness. The adhesive layers A2 are composed of a uv curable adhesive, for example. The adhesive layers A2, which are thicker than the thin adhesive layers A1, are used to bond the SLA 12 to the holder 13 to prevent the effects of the draft angles on the inner faces of the holder 13.

The holder 13 is composed of a material, such as liquid crystal polymer, having a lower linear expansion coefficient than that of the SLA 12. The holder 13 can support the light source substrate 11 and the SLA 12. The holder 13 may also be composed of any other resin or metal instead of liquid crystal polymer.

The holder 13 is supported by a base holder 15 therebelow in the Z direction. The base holder 15 is aligned to a mount (not shown) in the image forming apparatus 1000 by the alignment pins 16 and is fixed by an upward pressure in the Z direction from an elastic member (not shown), such as a spring.

The restraining plates 14 are each composed of a sheet of a metal such as stainless steel (SUS430) having a linear expansion coefficient lower than that of the SLA 12 and higher than that of the alkali-free glass (the base 111 of the light source substrate 11). The two restraining plates 14 are bonded with thin adhesive layers A3 to the respective side faces of the SLA 12 facing in the Y direction. The adhesive layers A3 are composed of a cyanoacrylate adhesive, for example. The restraining plates 14 may also be composed of glass (float glass) instead of the sheet metal. The adhesive layers A3 may be composed of any adhesive of, for example, a uv curable, anaerobic curable, or two-component type depending on the material and shapes of the restraining plates 14, other than the cyanoacrylate type.

In each restraining plate 14, the length in the Y direction (the direction perpendicular to the elongated faces of the SLA 12) is shorter than the length in the Z direction (the optical axis direction of the rod lenses 121 in the SLA 12). The length in the Y direction of the restraining plate 14 is invariable along the Z direction to avoid an increase in the stiffness in the Y direction.

The SLA 12 provided with the restraining plates 14 is referred to as "SLA unit (rod lens array unit) 17" in the embodiment.

Figure 6:
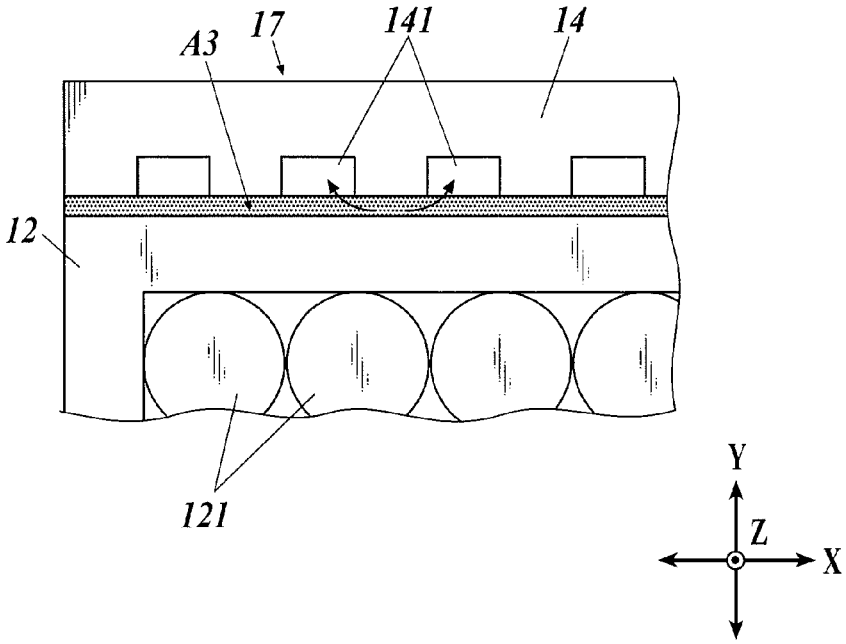
FIG. 6 is a plan view of recesses that receive an excess adhesive for bonding restraining plates to a rod lens array.

With reference to FIGS. 4 and 6, the restraining plates 14 each have multiple recesses 141 extending in the Z direction, which are aligned in the longitudinal direction (X direction) on the face of the restraining plate 14 adhering to the SLA 12. The recesses 141 are formed through machining in any step of the fabrication of the restraining plate 14. The recesses 141 may also be formed through surface treatment or press working instead of machining. According to the embodiment, the recesses 141 on the restraining plates 14 receive an excess adhesive for bonding the restraining plates 14 to the SLA 12 (refer to FIG. 6). It is preferred that the recesses 141 be disposed at regular intervals in the X direction, to equalize the shearing stress caused by a variation in environmental temperature on the joints between the restraining plates 14 and the SLA 12.

Each recess 141 should preferably have a small width to ensure the sufficient areas of the joints. It is more preferred that the width of the recesses 141 be determined depending on the viscosity of the adhesive layers A3 and the volume of the excess adhesive applied during the assembly.

Operations of the optical print head 100 according to the embodiment will now be explained.

Figure 7:
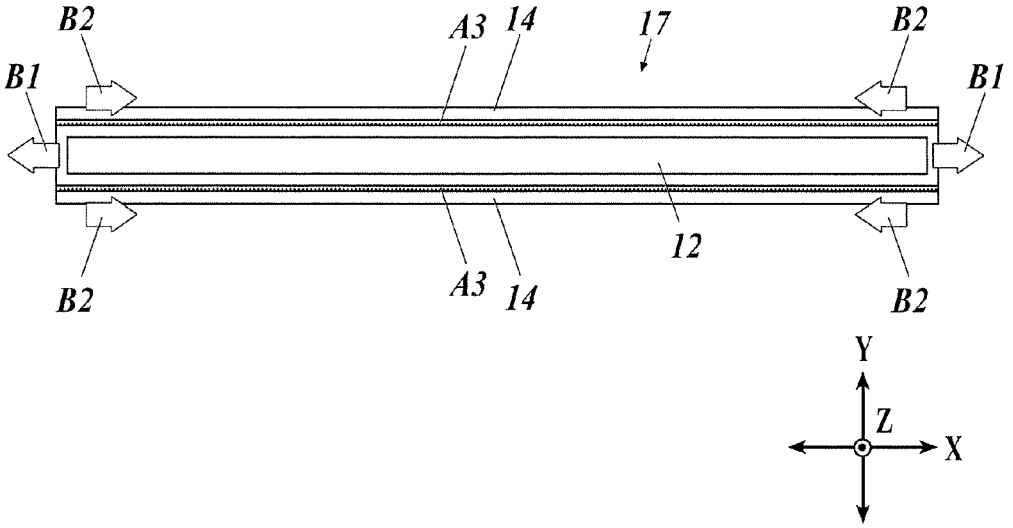
FIG. 7 illustrates the correlation between the expanding force of a rod lens array and the force of restraining plates to inhibit the expansion.

With reference to FIG. 7, the SLA 12 of the optical print head 100 has a higher linear expansion coefficient than those of the light source substrate 11 and the holder 13, and thus tends to expand in the X direction in response to an increase in environmental temperature (refer to arrows B1 in FIG. 7). The restraining plates 14 adhering to the SLA 12, however, have a lower linear expansion coefficient than that of the SLA 12, and thus tend to remain in the current state, exerting force to inhibit the expansion of the SLA 12 (refer to arrows B2 in FIG. 7). The overall linear expansion coefficient of the SLA unit 17 including the SLA 12 provided with the restraining plates 14 is thus lower than the linear expansion coefficient of the SLA 12. The overall linear expansion coefficient of the SLA unit 17 indicates an apparent linear expansion coefficient of the SLA unit 17 in the longitudinal direction, in more specific, a coefficient representing the sum of the expansion of the SLA 12 and the contraction of the restraining plates 14 bonded to the SLA 12 against the expansion of the SLA 12. According to the embodiment, the holder 13 supporting the light source substrate 11 and the SLA 12 has a lower linear expansion coefficient than that of the SLA 12.

The difference between the overall linear expansion coefficient of the SLA unit 17 including the SLA 12 provided with the restraining plates 14 and the linear expansion coefficient of the holder 13 is adjusted to be smaller than the difference between the linear expansion coefficient of the base 111 of the light source substrate 11 and that of the holder 13, so that the linear expansion coefficient of the holder 13 is relatively close to the overall linear expansion coefficient of the SLA unit 17. This adjustment can prevent the displacement of the centers of the SLA 12 relative to the holder 13 due to the difference in the linear expansion coefficient in response to a variation in environmental temperature. It is more preferred that the linear expansion coefficient of the holder 13 be substantially equal to the overall linear expansion coefficient of the SLA unit 17.

According to the embodiment, the restraining plates 14 are each composed of a sheet metal and have a Young's modulus much higher than that of the SLA 12 composed of an FRP. The overall linear expansion coefficient of the SLA unit 17 is thus close to the linear expansion coefficient of the restraining plates 14. In other words, the overall linear expansion coefficient of the SLA unit 17 approaches the linear expansion coefficient of the holder 13 through the adjustment of the difference in the linear expansion coefficient between the restraining plates 14 and the holder 13 to be smaller than the difference in the linear expansion coefficient between the base 111 and the holder 13.

The SLA 12 of the optical print head 100 is provided with the restraining plates 14 having multiple recesses 141, which receive an excess adhesive applied during the bonding of the restraining plates 14 to the SLA 12 (refer to FIG. 6). The recesses 141 ensure formation of thin adhesive layers and thus enable precise bonding via the thin adhesive layers. In addition, the recesses 141 disposed at regular intervals can equalize the shearing stress caused by a variation in environmental temperature on the joints between the restraining plates 14 and the SLA 12.

As described above, the optical print head 100 according to the embodiment includes the light source substrate 11 including the single base 111 and the multiple luminous elements (light sources) 112 disposed on the base, the SLA (rod lens array) 12 having a higher linear expansion coefficient than that of the base 111 of the light source substrate 11 to condense light L from the luminous elements 112 onto the image retainer 200, the holder 13 supporting the light source substrate 11 and the SLA 12, and the restraining plates 14 bonded with the thin adhesive layers A3 to the respective elongated faces of the SLA 12 that are parallel to the optical axis direction (Z direction) of the rod lenses 121 in the SLA 12. The light source substrate 11 is directly bonded to the holder 13 with the thin adhesive layers A1. The SLA 12 is bonded via the restraining plates 14 to the holder 13 with the adhesive layers A2 which are thicker than the thin adhesive layers A1. In each restraining plate 14, the length in the Y direction (the direction perpendicular to the elongated faces of the SLA 12) is shorter than the length in the Z direction. The restraining plates 14 and the holder 13 each have a lower linear expansion coefficient than that of the SLA 12.

In the optical print head 100 according to the embodiment, the length in the Y direction of the restraining plate 14 is shorter than the length in the Z direction, to ensure sufficient strength of the SLA 12 in the optical axis direction and to tightly fit the restraining plates 14 on the elongated faces of the SLA 12. This configuration can prevent the adhesive layers for bonding the restraining plates 14 to the SLA 12 from growing thicker and absorbing the difference in the linear expansion coefficient between the SLA 12 and the restraining plates 14, and thus can more efficiently reduce the linear expansion coefficient of the SLA 12.

The equalization of the thickness of the adhesive layers between the SLA 12 and each restraining plate 14 can prevent the partial peeling of the restraining plate 14 from the SLA 12 due to the local shearing stress in response to a variation in environmental temperature. The equalization thus can also efficiently reduce the linear expansion coefficient of the SLA 12, and can prevent a warp and distortion of the SLA unit 17 caused by the partial peeling.

The linear expansion coefficient of the restraining plates 14 lower than that of the SLA 12 leads to a reduction in the linear expansion coefficient of the SLA 12. The overall linear expansion coefficient of the SLA unit 17 thus approaches the linear expansion coefficient of the holder 13. This configuration can prevent the displacement of the center of the SLA 12 in response to a variation in environmental temperature, and thus can effectively prevent the displacement of the rod lenses 121 relative to the luminous points.

In the optical print head 100 according to the embodiment, the length in the Y direction of the restraining plates 14 is invariable along the Z direction to avoid an excess increase in the stiffness of the restraining plates 14 in the Y direction. The restraining plates 14 thus can tightly fit on the SLA 12. This configuration can more efficiently reduce the linear expansion coefficient of the SLA 12.

In the optical print head 100 according to the embodiment, the restraining plates 14 each have multiple recesses 141 extending in the Z direction, which are aligned in the X direction (longitudinal direction) on the face of the restraining plate 14 adhering to the SLA 12. The recesses 141 can receive the excess adhesive A3 applied during the bonding of the restraining plates 14 to the SLA 12. This configuration can prevent the adhesive layers A3 between the restraining plates 14 and the SLA 12 from being thick, and can reduce only the stiffness in the Y direction of the restraining plates 14 while not reducing the stiffness in the Z direction. The restraining plates 14 thus can more tightly fit on the SLA 12. This configuration can more efficiently reduce the linear expansion coefficient of the SLA 12.

The adhesive received A3 in the recesses 141 serves as an anchor, to enhance the adhesion between the adhesive layers A3 and the restraining plates 14 and to prevent the peeling of the restraining plates 14.

In the optical print head 100 according to the embodiment, the recesses 141 are formed through machining and thus can be readily provided at low costs.

In the optical print head 100 according to the embodiment, the recesses 141 are disposed at regular intervals in the X direction. Such recesses 141 can equalize the shearing stress, which is caused by the difference in the thermal expansion between the SLA 12 and the restraining plates 14 for reducing the linear expansion coefficient of the SLA 12, on the interfaces between the SLA 12 and the restraining plates 14. This configuration can prevent the peeling of the restraining plates 14 due to local stress concentration and thus can prevent a warp and distortion of the SLA 12 caused by the peeling.

In the optical print head 100 according to the embodiment, the difference between the overall linear expansion coefficient of the SLA unit 17, which includes the SLA 12 provided with the restraining plates 14, and the linear expansion coefficient of the holder 13 is adjusted to be smaller than the difference between the linear expansion coefficient of the base 111 and that of the holder 13. This adjustment can prevent the displacement of the longitudinal centers of the SLA 12 relative to the holder 13, and thus can prevent the displacement of the longitudinal centers of the SLA 12 relative to the light source substrate 11. The adjustment thus can avoid an inferior optical performance caused by the displacement of the centers of the SLA 12 relative to the light source substrate 11.

In the optical print head 100 according to the embodiment, the difference in the linear expansion coefficient between the restraining plates 14 each composed of a sheet metal and the holder 13 is adjusted to be smaller than the difference in the linear expansion coefficient between the base 111 and the holder 13. This adjustment can approximate the overall linear expansion coefficient of the SLA unit 17 to the linear expansion coefficient of the holder 13. The adjustment thus can avoid an inferior optical performance caused by the displacement of the centers of the SLA 12 relative to the light source substrate 11.

The above specific description illustrates an embodiment of the invention, but should not be construed to limit the invention. The embodiments can be modified without departing from the gist of the invention.

[Modification 1]

Figure 8:
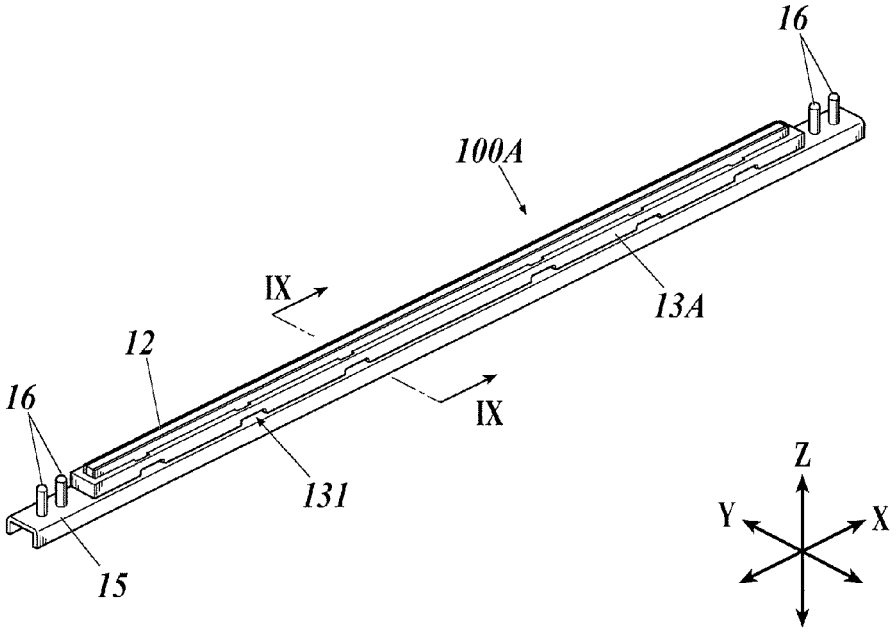
FIG. 8 is a perspective view of the entire configuration of an optical print head according to Modification 1.
Figure 9:
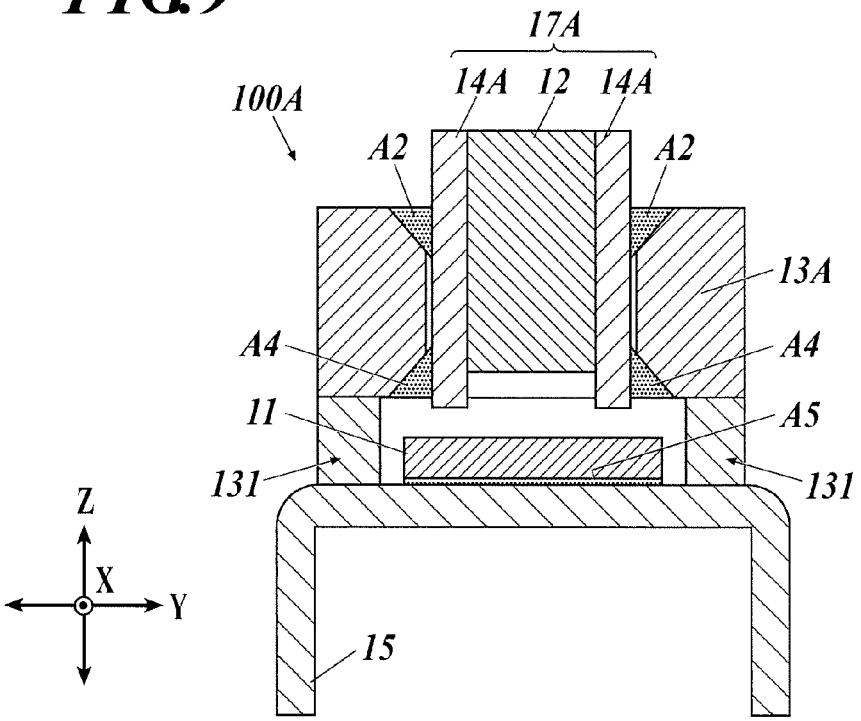
FIG. 9 is an example cross-sectional view of the optical print head illustrated in FIG. 8 along a line IX-IX.

For example, Modification 1 illustrated in FIGS. 8 and 9 differs from the above embodiment in the configurations of restraining plates 14A and a holder 13A. The components identical to those in the above embodiment are represented by the same reference signs and the redundant description thereof is omitted to simplify the description.

In specific, with reference to FIG. 9, restraining plates 14A of an optical print head 100A according to Modification 1 are longer than the SLA 12 in the optical axis direction (Z direction) of the rod lenses 121 in the SLA 12. The restraining plates 14A thus have an enhanced reinforcing effect in the Z direction. In addition, the restraining plates 14A are each bonded to the holder 13A at two upper and lower portions aligned in the Z direction with adhesive layers A2 and A4 which are thicker than a thin adhesive layer, respectively. This configuration can prevent a rotational displacement and distortion of the SLA 12. According to Modification 1, the light source substrate 11 is bonded to the base holder (intermediate member) 15 with a thin adhesive layer A5 in a plane (XY plane) substantially perpendicular to the Z direction, whereas the restraining plates 14A are each bonded to the holder 13A at the two upper and lower portions aligned in the Z direction. In other words, the light source substrate 11 is bonded via the base holder 15 to the holder 13A with the thin adhesive layer A5.

With reference to FIGS. 8 and 9, the holder 13A according to Modification 1 has uv windows 131 in both lower sides facing the Y direction. According to Modification 1, ultraviolet rays are applied through the uv windows 131 to the adhesive layers A4, so that the adhesive layers A4 fix the restraining plates 14A to the holder 13A. The uv windows 131 are sealed by a sealant or relatively flexible adhesive after the fixation.

The SLA 12 provided with the restraining plates 14A is referred to as "SLA unit 17A" in Modification 1.

As described above, the restraining plates 14A of the optical print head 100A according to Modification 1 are longer than the SLA 12 in the Z direction. The restraining plates 14A thus have increased stiffness against external stress in the Z direction, so that the SLA unit 17A is not readily distorted in the Z direction. Furthermore, the upper and lower portions bonding the SLA unit 17A to the holder 13A are spaced in the Z direction, to prevent a rotational displacement and distortion of the SLA unit 17A caused by external stress.

[Modification 2]

Figure 10:
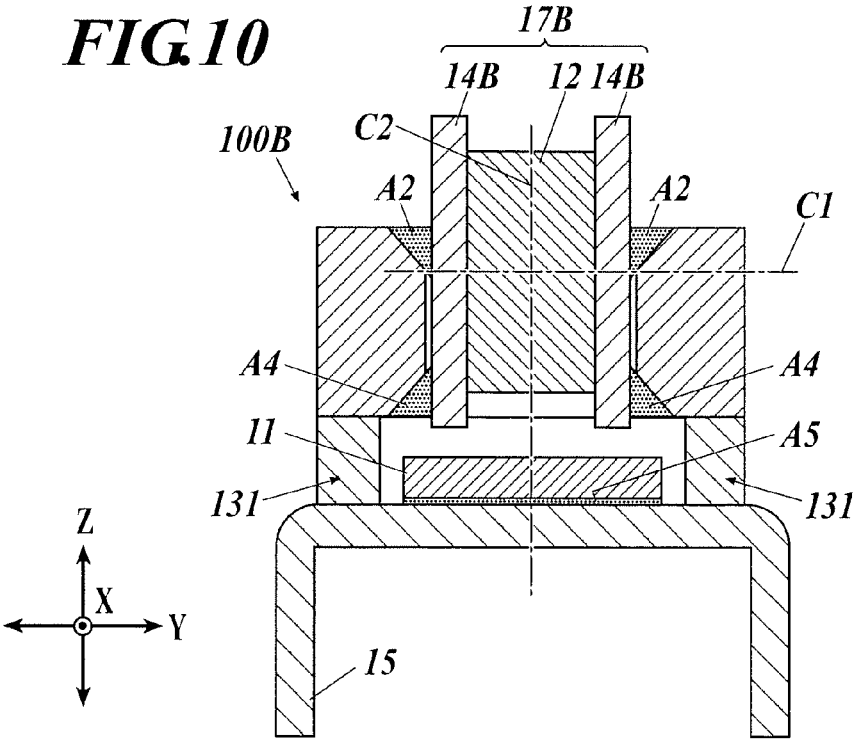
FIG. 10 is a schematic cross-sectional view of an optical print head according to Modification 2.
Figure 11:
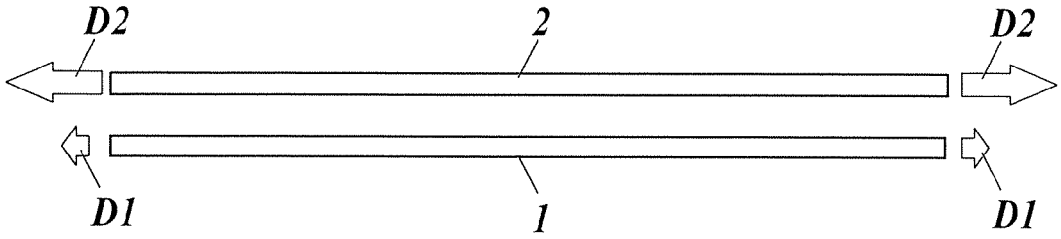
FIG. 11 illustrates a difference in the thermal expansion between a light source substrate and a rod lens array.
Figure 12:
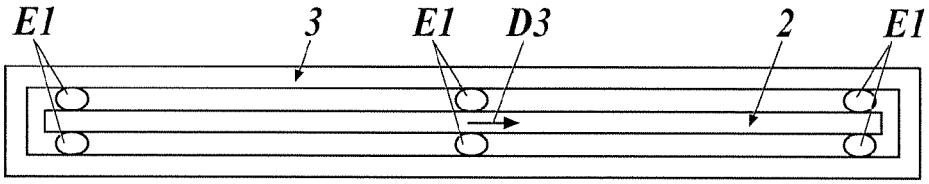
FIG. 12 illustrates an example mechanism of displacement of the longitudinal centers of a rod lens array relative to a holder due to the difference in the linear expansion coefficient.
Figure 13:
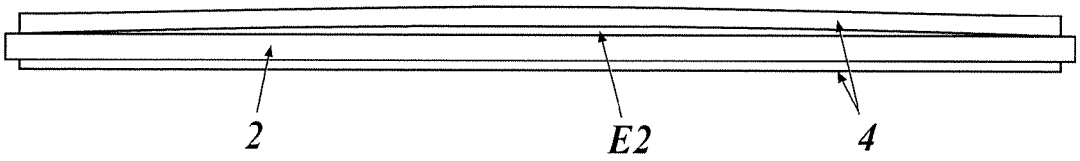
FIG. 13 illustrates an example adhesive layer having uneven thickness between a rod lens array and a restraining plate.

Modification 2 illustrated in FIG. 10 differs from Modification 1 in the configurations of restraining plates 14B. The components identical to those in the above embodiment and Modification 1 are represented by the same reference signs and the redundant description thereof is omitted to simplify the description.

In specific, with reference to FIG. 10, restraining plates 14B of an optical print head 100B according to Modification 2 are each bonded to the SLA 12 symmetrically about the plane (XY plane; represented by a reference sign C1 in FIG. 10) that extends through the center of the SLA 12 in the Z direction and is perpendicular to the Z direction.

The restraining plates 14B according to Modification 2 are also each symmetric about the plane (XZ plane; represented by a reference numeral C2 in FIG. 10) that extends through the center of the SLA 12 in the Y direction (the direction perpendicular to the elongated faces of the SLA 12) and is parallel to the elongated faces of the SLA 12.

The SLA 12 provided with the restraining plates 14B is referred to as "SLA unit 17B" in Modification 2.

As described above, the restraining plates 14B of the optical print head 100B according to Modification 2 are each symmetric about the plane that extends through the center of the SLA 12 in the Z direction and is perpendicular to the Z direction, and are each symmetric about the plane that extends through the center of the SLA 12 in the Y direction and is parallel to the elongated faces of the SLA 12.

In the optical print head 100B according to Modification 2, the SLA unit 17B is not readily warped in the Y or Z direction in response to a variation in environmental temperature.

[Other Modifications]

Although the restraining plates 14 each have multiple recesses 141 extending in the Z direction on the face of the restraining plate 14 adhering to the SLA 12 according to the above embodiment, this example should not be construed to limit the invention. For example, the SLA 12 may have multiple recesses extending in the Z direction on the faces of the SLA 12 adhering to the restraining plates 14, in place of the recesses 141 on the restraining plates 14.

The other detailed configurations and operations of the components of the optical print head and the image forming apparatus can be appropriately modified without departing from the gist of the invention.

An optical writer according to one aspect of preferred embodiments of the invention includes: a light source substrate including a base and multiple light sources disposed on the base; a rod lens array including multiple rod lenses having an optical axis, the rod lens array having a higher linear expansion coefficient than the linear expansion coefficient of the base of the light source substrate, the rod lens array being configured to condense light from the light sources onto an image retainer; a holder supporting the light source substrate and the rod lens array; and restraining plates bonded to the respective elongated faces of the rod lens array with thin adhesive layers, the elongated faces being parallel to the optical axis of the rod lenses. The light source substrate is bonded directly or via an intermediate member to the holder with a thin adhesive layer. The rod lens array is bonded via the restraining plates to the holder with adhesive layers which are thicker than the thin adhesive layer. The restraining plates each have a shorter length in the direction perpendicular to the elongated faces of the rod lens array than the length of the restraining plate in the direction of the optical axis. The restraining plates and the holder each have a lower linear expansion coefficient than the linear expansion coefficient of the rod lens array.

In the optical writer, the rod lenses are not displaced relative to the luminous points in response to a variation in environmental temperature. In addition, the rod lens array is not readily warped or distorted by the bonding of the restraining plates to the rod lens array.

The entire disclosure of Japanese Patent Application No. 2014-027281 filed on Feb. 17, 2014 is incorporated herein by reference in its entirety.

What is claimed is:

1. An optical writer comprising:

a light source substrate including a base and a plurality of light sources disposed on the base;

a rod lens array comprising a plurality of rod lenses having an optical axis, the rod lens array having a higher linear expansion coefficient than a linear expansion coefficient of the base of the light source substrate and the rod lens array being configured to condense light from the light sources onto an image retainer;

a holder supporting the light source substrate and the rod lens array; and restraining plates bonded to respective elongated faces of the rod lens array with thin adhesive layers, the elongated faces being parallel to the optical axis of the rod lenses, wherein the light source substrate is bonded directly or via an intermediate member to the holder with a thin adhesive layer, the rod lens array is bonded via the restraining plates to the holder with adhesive layers which are thicker than the thin adhesive layer, the restraining plates each have a shorter length in a direction perpendicular to the elongated faces of the rod lens array than a length of the restraining plate in a direction of the optical axis, and the restraining plates and the holder each have a lower linear expansion coefficient than the linear expansion coefficient of the rod lens array.

2. The optical writer according to claim 1, wherein the length of each of the restraining plates in the direction perpendicular to the elongated faces of the rod lens array is invariable along the optical axis.

3. The optical writer according to claim 1, wherein the restraining plates each comprise a plurality of recesses on a face adhering to the rod lens array, the recesses being disposed along the optical axis in a longitudinal direction of the restraining plate.

4. The optical writer according to claim 3, wherein the recesses are formed through machining.

5. The optical writer according to claim 3, wherein the recesses are disposed at regular intervals in the longitudinal direction.

6. The optical writer according to claim 1, wherein the rod lens array and the restraining plates adhering to the rod lens array define a rod lens array unit, and a difference between an overall linear expansion coefficient of the rod lens array unit and the linear expansion coefficient of the holder is smaller than a difference between the linear expansion coefficient of the base of the light source substrate and the linear expansion coefficient of the holder.

7. The optical writer according to claim 6, wherein the restraining plates are each composed of a sheet metal, and a difference between the linear expansion coefficient of the restraining plates and the linear expansion coefficient of the holder is smaller than the difference between the linear expansion coefficient of the base of the light source substrate and the linear expansion coefficient of the holder.

8. The optical writer according to claim 1, wherein the restraining plates are longer than the rod lens array in the direction of the optical axis.

9. The optical writer according to claim 1, wherein the restraining plates are symmetric about a plane extending through the center of the rod lens array in the direction of the optical axis, the plane being perpendicular to the optical axis.

10. The optical writer according to claim 1, wherein the restraining plates are symmetric about a plane extending through the center of the rod lens array in the direction perpendicular to the elongated faces of the rod lens array, the plane being parallel to the elongated faces of the rod lens array.

11. An image forming apparatus comprising:

an image retainer;

a charger to charge the image retainer;

the optical writer according to claim 1, the optical writer being configured to form an electrostatic latent image on the image retainer charged by the charger through irradiation of the image retainer with light;

a developer to convert the electrostatic latent image into a visible developer image through supply of a developing agent to the irradiated imager retainer;

a transferrer to transfer the developer image to a sheet; and a fixer to fix the developer image transferred by the transferrer onto the sheet.

* * * * *